US007607963B2

(12) United States Patent
Ishihara et al.

(10) Patent No.: US 7,607,963 B2
(45) Date of Patent: Oct. 27, 2009

(54) CONTROL APPARATUS FOR OPENING/CLOSING VEHICLE DOOR

(75) Inventors: Hiroshi Ishihara, Anjo (JP); Yasuyuki Kozawa, Kariya (JP); Junichi Matsunaga, Okazaki (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 403 days.

(21) Appl. No.: 11/454,796

(22) Filed: Jun. 19, 2006

(65) Prior Publication Data

US 2006/0283089 A1 Dec. 21, 2006

(30) Foreign Application Priority Data

Jun. 20, 2005 (JP) ..... 2005-179670

(51) Int. Cl.
*E05F 11/00* (2006.01)

(52) U.S. Cl. ..... 449/360; 318/264; 318/269

(58) Field of Classification Search ..... 49/31, 49/324, 360; 296/155; 318/264, 265, 268, 318/269, 282, 466
See application file for complete search history.

(56) References Cited

U.S. PATENT DOCUMENTS 5,892,340 A * 4/1999 Sasajima et al. ..... 318/293
6,087,794 A * 7/2000 Kawanobe ..... 318/446
6,134,837 A * 10/2000 Kawanobe et al. ..... 49/360
6,178,699 B1 * 1/2001 Kawanobe et al. ..... 49/360
6,226,925 B1 * 5/2001 Shimura et al. ..... 49/360
6,425,206 B1 * 7/2002 Noda et al. ..... 49/360
7,071,644 B2 * 7/2006 Kawanobe ..... 318/280
2004/0123525 A1 * 7/2004 Suzuki et al. ..... 49/360
2004/0212334 A1 * 10/2004 Kawanobe ..... 318/280

FOREIGN PATENT DOCUMENTS

JP 10-193978 A 7/1998
JP 2002144875 * 5/2002

* cited by examiner

*Primary Examiner*—Katherine W Mitchell
*Assistant Examiner*—Michael J Keller
(74) *Attorney, Agent, or Firm*—Buchanan Ingersoll & Rooney PC

(57) ABSTRACT

A control apparatus for opening/closing a vehicle door includes a door opening/closing mechanism for operating the vehicle door, a driving source for driving the door opening/closing mechanism, a connecting/disconnecting apparatus interposed between the door opening/closing mechanism and the driving source, and a controlling apparatus for controlling the connecting/disconnecting apparatus. The controlling apparatus for opening/closing the vehicle door includes a door movement-detecting apparatus for detecting a movement of the vehicle door. The controlling apparatus switches the connecting/disconnecting apparatus from a connected state to a disconnected state when the driving source is stopped during in an opening/closing operation of the vehicle door. The controlling apparatus performs a repetition mode, in which the connecting/disconnecting apparatus repeats the connected state and the disconnected state, when the movement of the vehicle door is detected in the disconnected state of the connecting/disconnecting apparatus.

19 Claims, 7 Drawing Sheets

CONTROL APPARATUS FOR OPENING/CLOSING VEHICLE DOOR

CROSS REFERENCE TO RELATED APPLICATIONS

This application is based on and claims priority under 35 U.S.C. § 119 to Japanese Patent Application 2005-179670, filed on Jun. 20, 2005, the entire content of which is incorporated herein by reference.

FIELD OF THE INVENTION

This invention generally relates to a control apparatus for opening/closing a vehicle door. More specifically, this invention pertains to a control apparatus, which drives a vehicle door to open/close by a driving source, for opening/closing a vehicle door.

BACKGROUND

Conventionally, opening/closing apparatuses that drive a slide door, which is provided at a side portion of a vehicle for passengers to get on/off, and that open/close the slide door by using a driving source such as motors, are widely known. In such an opening/closing device, on the basis of an operation from inside/outside the vehicle, a control apparatus installed in the vehicle starts the driving source, the driving force from the driving source is transmitted to an opening/closing mechanism of the slide door through an electromagnetic clutch, and the slide door is thus operated to open/close. Then, the opening/closing device is configured so that the opening/closing device can selectively be switched between an automatic opening/closing mode, in which the clutch is switched to the connected state and the slide door is opened/closed by the driving force of the driving source, and a manual opening/closing mode, in which the clutch is switched to the disconnected state so that the slide door can be manually operated by an occupant.

Meanwhile, when the manual mode is selected while the slide door is operated in the automatic opening/closing mode, the opening/closing device is switched to the manual opening/closing mode while the slide door is stopped in the middle of the operation and the electromagnetic clutch is switched to the disconnected state. Further, when an entrapment of an obstacle is detected or an ignition switch is switched off while the slide door is operated in the automatic opening/closing mode, there is a possibility that the slide door is stopped in the middle of the operation and is controlled to be switched to the manual opening/closing mode. When the door opening/closing device is switched to the manual opening/closing mode described above while the vehicle stops on a sloping ground, there is a danger that the slide door starts moving, on a self-weight basis, in an inclined direction.

In the light of the foregoing, an opening/closing control apparatus is suggested, which controls an electromagnetic clutch to repeat a connected state and a disconnected state when the door opening/closing device is switched to the manual opening/closing mode while the slide door is in a partially-opened state, in which the slide door is positioned between a fully-opened position and a fully-closed position (for example, JP3445083B). In the opening/closing control apparatus suggested above, the electromagnetic clutch repeats the connected state and the disconnected state to intermittently give a load from the driving source to the opening/closing mechanism of the slide door, therefore a rapid movement of the slide door in an inclined direction can be restricted.

Meanwhile, in such an opening/closing control apparatus, the electromagnetic clutch is controlled to necessarily repeat the connected state and the disconnected state when the opening/closing control apparatus is switched to the manual opening/closing mode while the slide door is in the partially-opened state. Therefore, the number of operations of the electromagnetic clutch increases. Accordingly, durability of the electromagnetic clutch needs to be set higher, which leads to an increase in cost of products. In addition, the increase of the number of operations of the electromagnetic clutch tends to cause higher battery consumption and tends to cause a generation of annoying operational noise.

A need thus exists for a control apparatus for opening/closing a vehicle door, which can restrict, with a reduced number of operations of an electromagnetic clutch, a movement of a vehicle door, on a self-weight basis, when the vehicle door is in a partially-opened state. The present invention has been made in view of the above circumstances and provides such a control apparatus for opening/closing a vehicle door.

SUMMARY OF THE INVENTION

According to an aspect of the present invention, a control apparatus for opening/closing a vehicle door includes:

a door opening/closing mechanism for operating the vehicle door to open/close;

a driving source for driving the door opening/closing mechanism;

a connecting/disconnecting means which can be switched between a connected state, in which a driving force is transmitted to the vehicle door from the driving source, and a disconnected state, in which the driving force is not transmitted to the vehicle door from the driving source, the connecting/disconnecting means interposed between the door opening/closing mechanism and the driving source;

a controlling means for controlling the connecting/disconnecting means to the connected state or to the disconnected state;

a door movement-detecting means for detecting a movement of the vehicle door;

the controlling means switching the connecting/disconnecting means from the connected state to the disconnected state when the driving source is stopped during an opening/closing operation of the vehicle door by the driving source; and the controlling means performing a repetition mode, in which the connecting/disconnecting means repeats the connected state and the disconnected state, when the movement of the vehicle door is detected by the door movement-detecting means in the disconnected state of the connecting/disconnecting means.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

A first embodiment of the present invention will be explained with reference to FIGS. 1 to 5. In the first embodiment, a control apparatus for opening/closing a vehicle door is applied to an opening/closing control of a slide door provided at a side portion of the vehicle.

Figure 1:
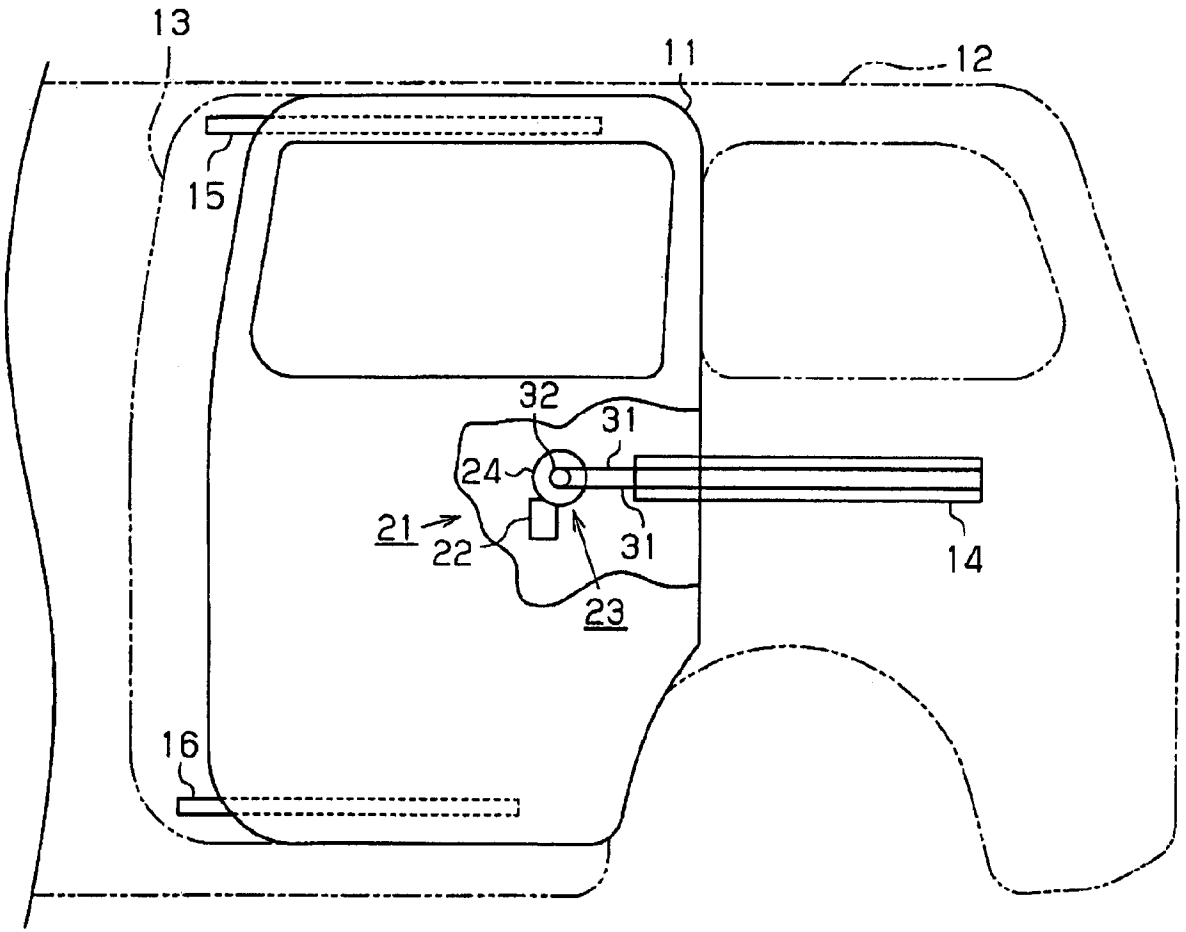
FIG. 1 represents a side view illustrating a vehicle with which a control apparatus for opening/closing a vehicle door is equipped.

FIG. 1 represents a diagram illustrating a schematic configuration of a slide door 11. The slide door 11, which serves as a vehicle door, is driven so as to open/close an entrance 13 formed at a side body 12 of the vehicle. The slide door 11 is slidably supported by a center guide rail 14, which extends in a fore-aft direction of the side body 12, and an upper guide rail 15 provided at an upper part of the side body 12, and a lower guide rail 16 provided at a lower part of the side body 12. A driving mechanism 21 for the slide door, which drives the slide door 1, is provided at the slide door 11.

The driving mechanism 21 for the slide door includes an electric motor 22 which serves as a driving source, a door opening/closing mechanism 23, which operates the slide door 11 to open/close, and an electromagnetic clutch 24, which serves as a connecting/disconnecting means and which is provided between the electric motor 22 and the door opening/closing mechanism 23.

The door opening/closing mechanism 23 includes a cable 31, linked to the side body 12, and a drum 32, around which the cable 31 is wound. Rotation of the drum 32, for winding or feeding the cable 31 to/from the drum 32, operates the slide door 11 so as to slide relative to the side body 12.

The electromagnetic clutch 24 is configured so that the electromagnetic clutch 24 can be switched between a connected state, in which a driving force of the electric motor 22 is transmitted to the drum 32 of the door opening/closing mechanism 23, and a disconnected state, in which the driving force of the electric motor 22 is not transmitted to the drum 32 of the door opening/closing mechanism 23. In an automatic opening/closing mode, in which the slide door 11 is opened/closed by the electric motor 22, the electromagnetic clutch 24 switches to the connected state. In a manual opening/closing mode, in which an occupant can manually operate the slide door 11, the electromagnetic clutch 24 switches to the disconnected state.

Figure 2:
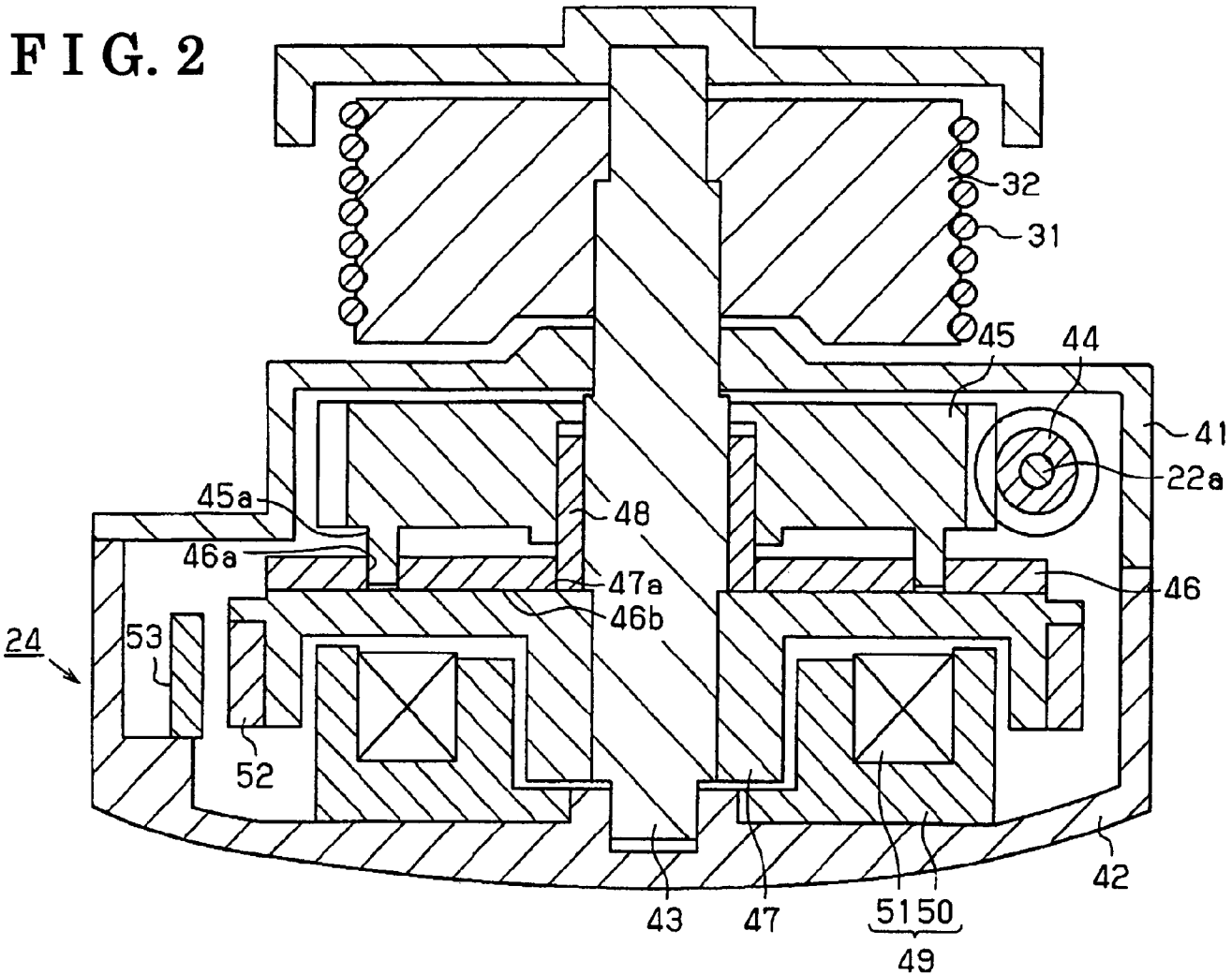
FIG. 2 represents a cross-sectional view illustrating an electromagnetic clutch.

FIG. 2 represents a diagram illustrating a schematic configuration of the electromagnetic clutch 24. An outline of the electromagnetic clutch 24 is formed by an upper housing 41 and a lower housing 42. The electric motor 22 is attached to the housing 41 and the housing 42. A rotational shaft 43 of the drum 32 is rotatably supported by the housing 41 and the housing 42. In the connected state of the electromagnetic clutch 24, the driving force of the electric motor 22 is transmitted to the rotational shaft 43 through a worm gear 44, a worm wheel gear 45, an armature 46, and a rotor 47.

The worm gear 44 is fixed to an output shaft 22*a* of the electric motor 22 so that the worm gear 44 can integrally rotate with the output shaft 22*a* of the electric motor 22. The worm gear 44 is located so that the worm gear 44 engages with the worm wheel gear 45. The worm wheel gear 45 is supported at the rotational shaft 43 through a spacer 48 so that the worm wheel gear 45 can rotate relatively to the rotational shaft 43. The armature 46 is a disc-shaped magnetic body. The armature 46 is supported at the rotational shaft 43 through the spacer 48 so that the armature 46 can rotate relative to the rotational shaft 43 and so that the armature 46 can move in an axial direction of the rotational shaft 43. Plural holes 46*a* are formed at the armature 46. The holes 46*a* are fitted to plural projections 45*a* formed at the worm wheel gear 45. Because of this, the armature 46 integrally rotates with the worm wheel gear 45. The rotor 47 is fixed to the rotational shaft 43 so that the rotor 47 integrally rotates with the rotational shaft 43. An upper surface 47*a* of the rotor 47 is located so as to face a lower surface 46*b* of the armature 46. A ring-shaped electromagnetic coil 49 is provided under the rotor 47 around the rotational shaft 43. The electromagnetic coil 49 includes a core 50 made of a magnetic material and a coil 51, to which electricity can be supplied from outside. The electromagnetic coil 49 is fixed to the lower housing 42.

In the configuration described above, when electricity is supplied to the coil 51 of the electromagnetic coil 49, a magnetic closed loop is formed between the coil 51, the core 50, the rotor 47, and the armature 46. Accordingly, an electromagnetic force, which pulls the armature 46 toward the rotor 47, is generated. The electromagnetic force moves the armature 46 toward the rotor 47 in an axial direction. Then, the lower surface 46*b* of the armature 46 frictionally engages with the upper surface 47*a* of the rotor 47. Because of this, the electromagnetic clutch 24 switches to the connected state. On the other hand, when supply of electricity to the coil 51 of the electromagnetic coil 49 is cut out, the electromagnetic force, which pulls the armature 46 toward the rotor, disappears. Accordingly, frictional engagement of the armature 46 with the rotor 47 is released. Because of this, the electromagnetic clutch 24 switches to the disconnected state.

Further, a ring-shaped magnet 52 is fixed at an outer peripheral edge of the rotor 47. The magnet 52 is magnetized so that plural groups of N/S poles are alternately arranged at an outer peripheral surface of the magnet 52. A sensor 53, which serves as a door movement-detecting means, is provided at a position, which faces the outer peripheral surface of the magnet 52. The sensor 53 is fixed to the lower housing 42. The sensor 53 includes two Hall elements located so that a phase of each Hall element shifts from one another. The Hall element outputs a pulse signal according to a change of the N/S polarity of the magnet 52. Because of this, the sensor 53 can detect rotation and rotational direction of the rotor 47. Further, the rotor 47 integrally rotates with the drum 32 through the rotational shaft 43, and the slide door 11 is able to move because of the rotation of the drum 32. Accordingly, the sensor 53 can detect an operational state of the slide door 11.

Figure 3:
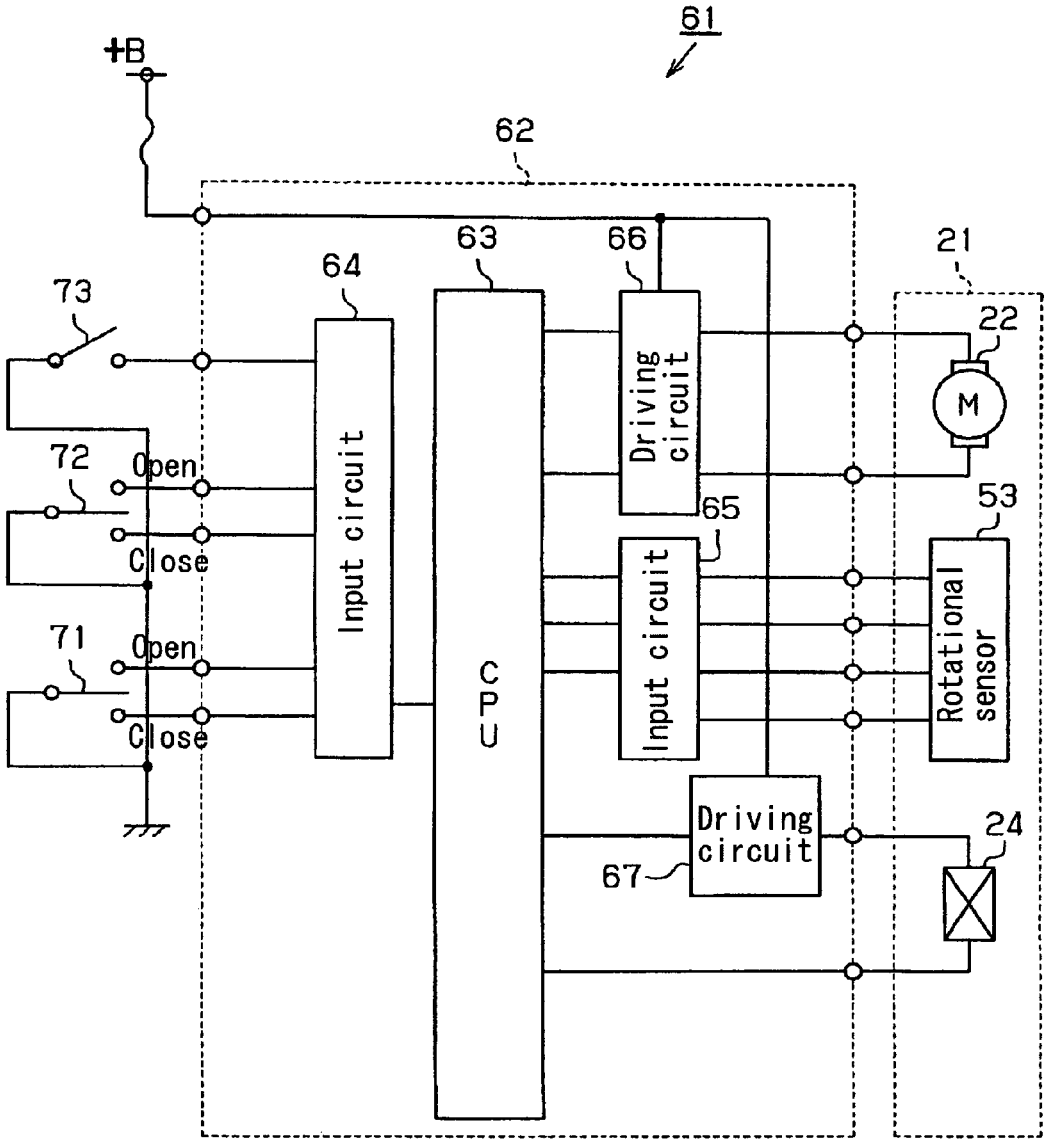
FIG. 3 represents a diagram illustrating a system configuration of the control apparatus for opening/closing the vehicle door.

FIG. 3 represents a diagram illustrating a system configuration of a control apparatus 61 for controlling the opening/closing operation of the slide door 11. The control apparatus 61 is configured so that a controller 62 controls the opening/closing operation of the slide door 11. The controller 62, which serves as a controlling means, includes a central processing unit (CPU) 63, for performing an opening/closing control of the slide door 11, input circuits 64 and 65, to which a signal from a sensor or a switch is inputted, and driving circuits 66 and 67, for driving an external device. Further, a predetermined power source (+B) is supplied to the controller 62 from a battery of the vehicle.

Signals, outputted from an outside operational switch 71, an inside operational switch 72, and a main switch 73, are inputted into the input circuit 64. Open operation signals/close operation signals of the slide door 11 are inputted into the input circuit 64 from the outside operational switch 71 and from the inside operational switch 72. The main switch 73 switches between the automatic opening/closing mode and the manual opening/closing mode of the slide door 11. Signals indicating these modes are inputted into the input circuit 64 from the main switch 73. When the main switch 73 is set to the manual opening/closing mode, the input circuit 64 does not receive signals from the outside operational switch 71 and the inside operational switch 72. Further, signals from the sensor 53 are inputted into the input circuit 65. These signals are inputted into the CPU 63. The electric motor 22 is connected to the driving circuit 66. The electromagnetic clutch 24 is connected to the driving circuit 67. The electric motor 22 and the electromagnetic clutch 24 are driven and controlled on the basis of drive signals outputted from the CPU 63.

Next, an entrapment control will be explained. When the controller 62 detects an entrapment of an obstacle, during the opening/closing operation of the slide door 11, the controller 62 performs an entrapment control for operating the slide door 11 in a reverse direction. The controller 62 monitors signals from the sensor 53 while the slide door 11 is driven and operated by the electric motor 22 for performing the entrapment control. In other words, the controller 62 monitors a rotational frequency of the drum 32 detected by the sensor 53. When a change of value of the rotational frequency is equal to or higher than a predetermined value, the controller 62 detects that an obstacle is entrapped by the slide door 11. Then, the controller 62 operates the slide door 11 in a reverse direction. After the entrapment control, the controller 62 operates the slide door in a reverse direction (initial opening/closing direction) again on the basis of the operation signals from the outside operational switch 71 or the inside operational switch 72. Accordingly, when the obstacle is not removed, the slide door 11 repeats reciprocating operations. Therefore, when the entrapment control is performed continuously, for a predetermined number of times, the controller 62 stops the operation of the slide door 11, and switches the slide door 11 to the manual opening/closing mode.

Figure 4:
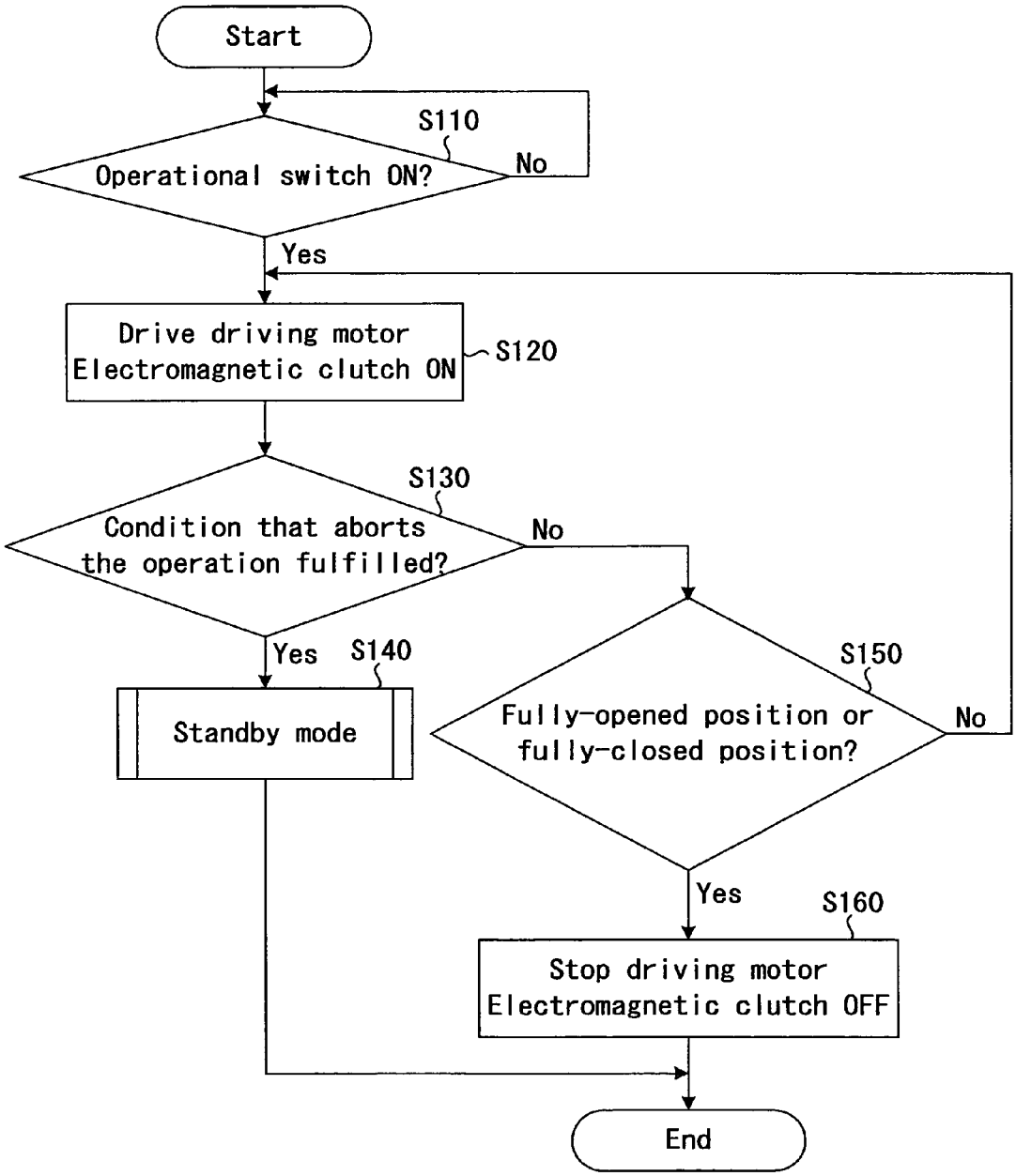
FIG. 4 represents a flow chart illustrating a procedure of an opening/closing operation of the slide door.

Next, an opening/closing operation control of the slide door 11 will be explained. FIG. 4 represents a flow chart illustrating an opening/closing operation routine of the slide door 11 in the automatic opening/closing mode. This routine is performed when the main switch 73 is set to the automatic opening/closing mode.

When the routine is started, the controller 62 determines whether or not the opening/closing operation signal is inputted from the outside operational switch 71 or the inside operational switch 72 (step S110). When the opening/closing operation signal is not inputted, the controller 62 repeatedly performs this step. When the opening/closing operation signal is inputted, the controller 62 drives the electric motor 22 and switches the electromagnetic clutch 24 to the connected state (step S120). Then, when the slide door 11 is in a partially-opened state during the opening/closing operation, the controller 62 determines whether or not a condition that aborts the operation is fulfilled (step S130). The condition that aborts the operation is a condition for aborting the automatic opening/closing operation of the slide door 11 by stopping the electric motor 22 (stopping the driving source transmitting the driving force) in the middle of the operation. Cases where the main switch 73 is operated and switched to the manual opening/closing mode during the automatic opening/closing operation, or cases where the entrapment is detected during the automatic opening/closing operation and the slide door 11 is stopped, or cases where an ignition switch is switched to an off-state during the automatic opening/closing operation, or the like, may serve as examples. In those cases, the controller 62 determines that the condition that aborts the operation is fulfilled, and transits to a standby mode (step S140).

If the condition that aborts the operation is not fulfilled, the controller 62 determines whether or not the slide door 11 is at a fully-opened position or at a fully-closed position (step S150). When the slide door 11 is not at the fully-opened position or at the fully-closed position, the controller 62 goes back to the step S120 and continues operating the slide door 11 by the electric motor 22. When the slide door 11 is at the fully-opened position or the fully-closed position, the controller 62 stops the electric motor 22, and switches the electromagnetic clutch 24 to the disconnected state (step S160).

Figure 5:
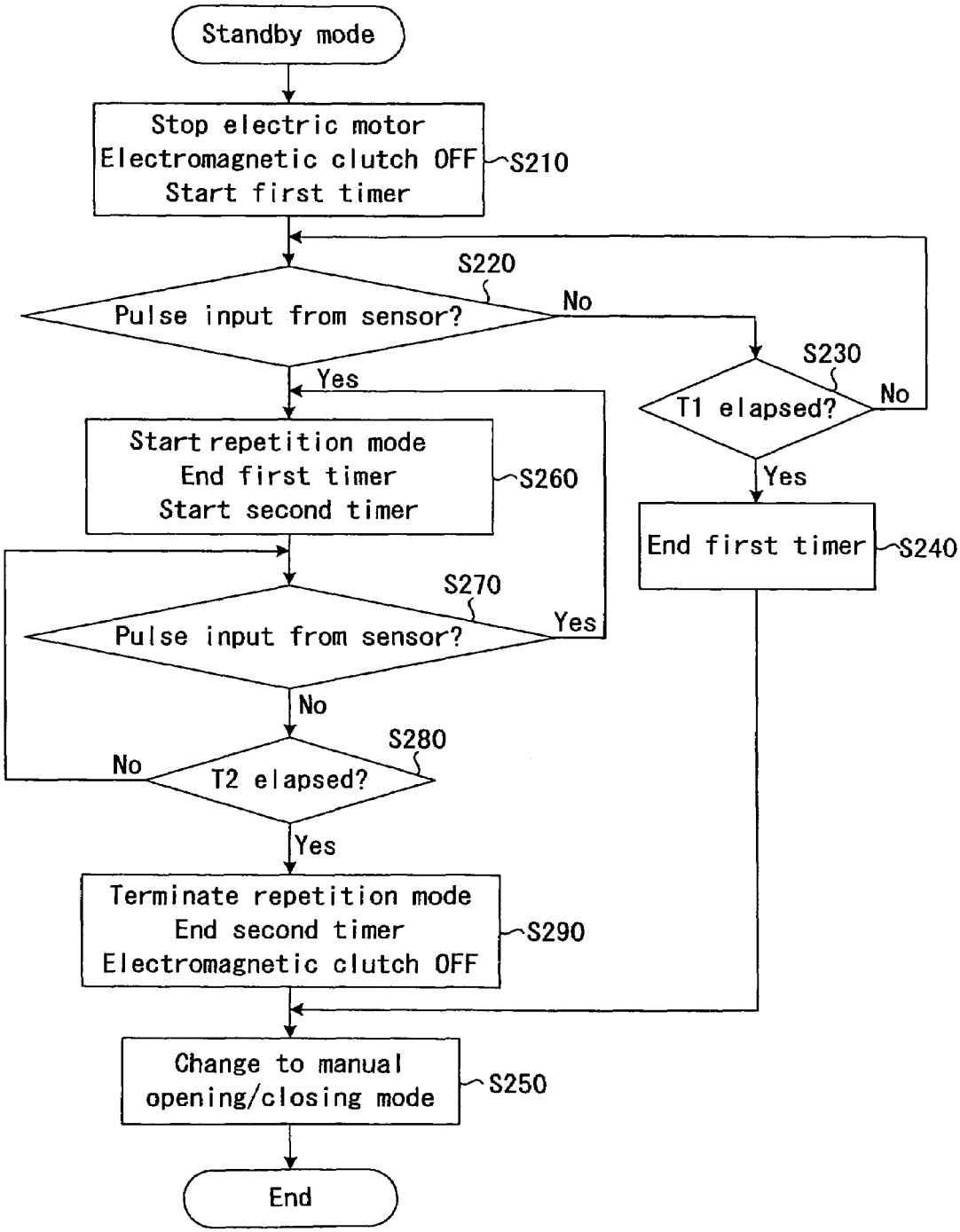
FIG. 5 represents a flow chart illustrating a procedure of a process in a standby mode.

Next, a process in the standby mode will be explained. FIG. 5 represents a flow chart illustrating the process in the standby mode. When the controller 62 transits to the standby mode, the controller 62 stops the electric motor 22 and switches the electromagnetic clutch 24 to the disconnected state. At the same time, the controller 62 starts a first timer (step S210). Next, the controller 62 determines whether or not a movement of the slide door 11 is detected on the basis of a pulse signal outputted from the sensor 53 (step S220). When a pulse is inputted to the controller 62 from the sensor 53, the controller 62 judges that the slide door 11 is moving. Then, when the movement of the slide door 11 is not detected, the controller 62 determines whether or not a predetermined period of time T1 (first predetermined period of time) has elapsed from a start time of the first timer (step S230). In a case where the predetermined period of time T1 has not elapsed, the controller 62 goes back to the step S220. In a case where the predetermined period of time T1 has elapsed, the controller 62 ends the first timer (step S240), and changes the slide door 11 to the manual opening/closing mode (step S250). In other words, in a case where the movement of the slide door 11 has not been detected within the predetermined period of time T1, it can be judged that the slide door 11 is not in a state where the slide door 11 moves on the self-weight basis. Accordingly, the controller 62 changes the slide door 11 to the manual opening/closing mode from the standby mode. On the other hand, when the movement of the slide door 11 is detected within the predetermined period of time T1, it can be judged that the slide door 11 is moving, on the self-weight basis, because the vehicle is stopped on a sloping ground, or the like. Accordingly, the controller 62 performs a following process.

When the movement of the slide door 11 is detected at the step S220, the controller 62 performs a repetition mode (step S260). The repetition mode means an operation state in which the electromagnetic clutch 24 repeats the connected state and the disconnected state. The repetition mode is performed by repeating a state in which electricity is supplied to the coil 51 of the electromagnetic coil 49 and a state in which electricity is not supplied thereto. When the electromagnetic clutch 24 is in the connected state, a rotational load of the electric motor 22 acts as a breaking force against the movement of the slide door 11. Accordingly, a moving speed of the slide door 11 can be lowered. Then, the controller 62 ends the first timer and starts a second timer simultaneously with the start time of performing the repetition mode.

Next, the controller 62 determines whether or not the movement of the slide door 11 is detected on the basis of the pulse signal output from the sensor 53 (step S270). When the movement of the slide door 11 is detected, the controller 62 goes back to the step S260 to continue the repetition mode. At the same time, the controller 62 resets the second timer. In other words, when the movement of the slide door 11 is detected while the repetition mode is performed, it can be predicted that the slide door 11 will move rapidly when the repetition mode stops. Accordingly, the controller 62 continues the repetition mode.

When the movement of the slide door 11 is not detected, the controller 62 determines whether or not a predetermined period of time T2 (second predetermined period of time) has elapsed from the start time of the second timer (step S280). If the predetermined period of time T2 has not elapsed, the controller 62 goes back to the step S270. If the predetermined period of time T2 has elapsed, the controller 62 ends the second timer and terminates the repetition mode (step S290). Then, the controller 62 switches the electromagnetic clutch 24 to the disconnected state, and changes the slide door 11 to the manual opening/closing mode (step S250).

Thus, if the movement of the slide door 11 is not detected within the predetermined period of time T1 from the start time of the first timer, the controller 62 immediately changes the slide door 11 to the manual opening/closing mode from the standby mode. On the other hand, if the movement of the slide door 11 is detected within the predetermined period of time T1, the controller 62 performs the repetition mode, and after that, changes the slide door 11 to the manual opening/closing mode.

According to the first embodiment described above, following effects can be obtained.

(1) In the first embodiment, when the condition that aborts the operation is fulfilled while the slide door 11 is in the partially-opened state during the opening/closing operation, the controller 62 transits to the standby mode. At this time, the controller 62 stops the electric motor 22 and switches the electromagnetic clutch 24 to the disconnected state. When the movement of the slide door 11 is detected, at this state, the controller 62 performs the repetition mode. Accordingly, if the movement of the slide door 11 is not detected, the controller 62 does not perform the repetition mode. Therefore, unnecessary switching of the electromagnetic clutch 24 can be inhibited. Accordingly, the number of switching operations of the electromagnetic clutch 24 can be reduced. As a result, improvement of durability of the electromagnetic clutch 24, reduction in the amount of switching work of the electromagnetic clutch 24, and restriction of annoying operational noise, can be expected. On the other hand, when the movement of the slide door 11 is detected, the controller 62 performs the repetition mode. Therefore, the braking force of the electric motor 22 can be intermittently given to the door opening/closing mechanism 23. Accordingly, rapid movement of the slide door 11, on the self-weight basis in an inclined direction, can be restricted. As a result, an occupant's safety can be ensured.

(2) In the first embodiment, in the standby mode, when the movement of the slide door 11 is detected within the predetermined period of time T1 from the time when the electromagnetic clutch 24 is switched to the disconnected state, the controller 62 performs the repetition mode. Accordingly, when the movement of the slide door 11 is not detected within the predetermined period of time T1, the controller 62 can immediately change the slide door 11 to the manual opening/closing mode from the standby mode after the predetermined period of time T1 has elapsed.

(3) In the first embodiment, when the movement of the slide door 11 is detected while the electromagnetic clutch 24 is in the disconnected state, it is judged that the vehicle is stopped on a sloping ground and the slide door 11 is moving on the self-weight basis. Accordingly, the controller 62 performs the repetition mode. Therefore, rapid movement of the slide door 11, on the self-weight basis, in an inclined direction, can be restricted by a simple configuration without newly providing a sensor for detecting inclination of the vehicle, or the like.

(4) In the first embodiment, when the movement of the slide door 11 is not detected within the predetermined period of time T2 from the start time of performing the repetition mode, the controller 62 terminates the repetition mode. Accordingly, when the movement of the slide door 11 is restricted by the repetition mode, more than necessary operations of the electromagnetic clutch 24 can be inhibited. Further, when the movement of the slide door 11 is detected while the controller 62 performs the repetition mode, it can be predicted that the slide door 11 will rapidly move if the controller 62 stops the repetition mode. Accordingly, the controller 62 continues the repetition mode. As a result, the occupant's safety can be ensured.

Next, a second embodiment will be explained. The second embodiment and a third embodiment, which will be explained later, are different from the first embodiment in a process during the standby mode (refer to FIG. 5). In the embodiments explained below, identical reference numbers will be applied to the same configurations as those in the first embodiment, and redundant explanations thereof will be skipped or simplified.

Figure 6:
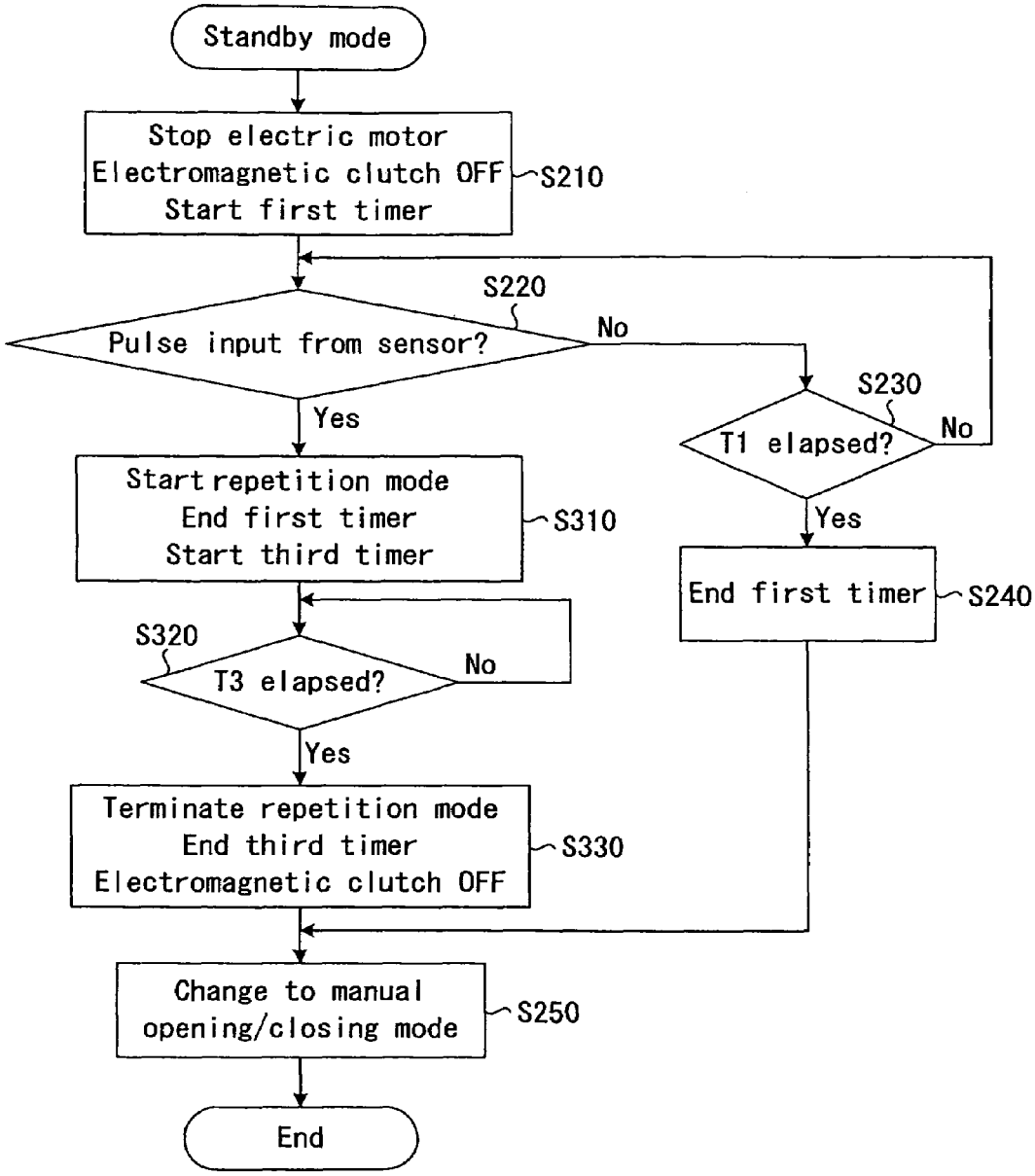
FIG. 6 represents a flow chart illustrating a procedure of a process in a standby mode according to a second embodiment.

FIG. 6 represents a flow chart illustrating a process in the standby mode. Processes from the step S210 to the step S250, in the flow chart of FIG. 6, are the same as those in the flow chart of FIG. 5. Processes from step S310 to step S330, which are different from those in the flow chart of FIG. 5, will be explained.

When the movement of the slide door 11 is detected within the predetermined period of time T1, from the start time of the first timer (YES at the step S220), the controller 62 performs the repetition mode (step S310). Then, at the time when the controller 62 starts the repetition mode, the controller 62 ends the first timer and starts a third timer. Next, the controller 62 determines whether or not a predetermined period of time T3 (third predetermined period of time) has elapsed from the start time of the third timer (step S320). In a case where the predetermined period of time T3 has not elapsed, the controller 62 repeatedly performs this step. When the predetermined period of time T3 has elapsed, the controller 62 ends the third timer and terminates the repetition mode (step S330). Then, the controller 62 switches the electromagnetic clutch 24 to the disconnected state, and changes the slide door 11 to the manual opening/closing mode (step S250). Thus, when the movement of the slide door 11 is detected within the predetermined period of time T1 from the start time of the first timer, the controller 62 performs the repetition mode for the predetermined period of time T3, and after that, the controller 62 changes the slide door 11 to the manual opening/closing mode.

According to the second embodiment described above, in addition to the effects of the first embodiment (first to third), following effects can be obtained.

(5) In the second embodiment, the controller 62 terminates the repetition mode after the predetermined period of time T3 has elapsed from the start time of performing the repetition mode. Accordingly, rapid movement of the slide door 11, on the self-weight basis, in an inclined direction, can be restricted for the predetermined period of time T3. At the same time, after the predetermined period of time T3 has elapsed, the controller 62 can immediately change the slide door 11 to the manual opening/closing mode from the repetition mode.

Figure 7:
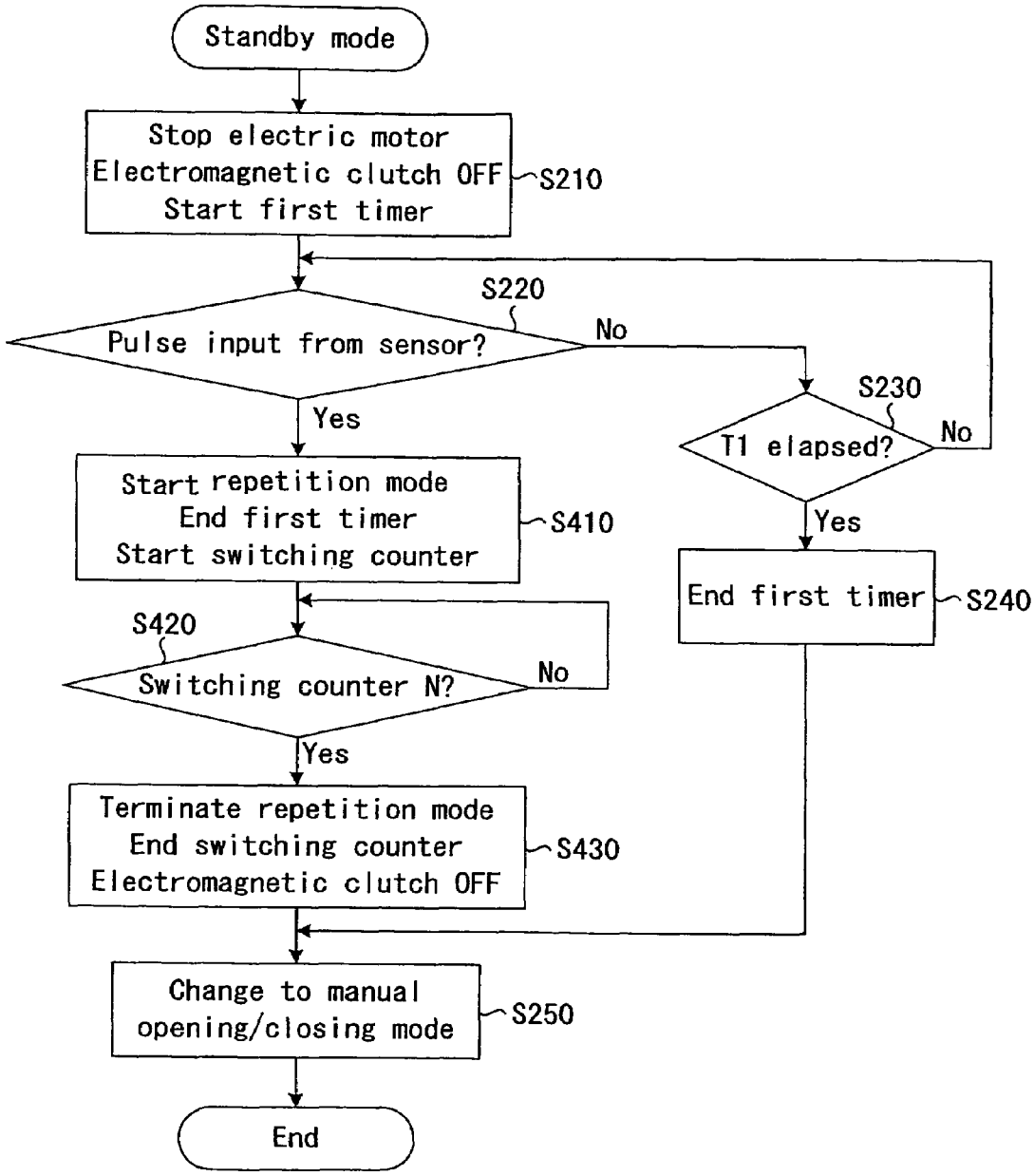
FIG. 7 represents a flow chart illustrating a procedure of a process in a standby mode according to a third embodiment.

Next, a third embodiment will be explained. FIG. 7 represents a flow chart illustrating a process in the standby mode. Processes from the step S210 to the step S250 in the flow chart of FIG. 7 are the same as those in the flow chart of FIG. 5. Processes from step S410 to step S430, which are different from those in the flow chart of FIG. 5, will be explained.

When the movement of the slide door 11 is detected within the predetermined period of time T1 (YES at the step S220), the controller 62 performs the repetition mode (step S410). Then, the controller 62 ends the T1 timer, and starts a switching counter, simultaneously with the start time of performing the repetition mode. The switching counter counts the number of times that the electromagnetic clutch 24 is switched to the connected state from the disconnected state. Next, the controller 62 determines whether or not the switching counter has counted a predetermined number of times N (step S420). When the switching counter has not counted the predetermined number of times N, the controller 62 repeatedly performs this step. When the switching counter has counted the predetermined number of times, the controller 62 ends the switching counter, and terminates the repetition mode (step S430). Then, the controller 62 switches the electromagnetic clutch 24 to the disconnected state, and changes the slide door 11 to the manual opening/closing mode (step S250). Thus, when the movement of the slide door 11 is detected within the predetermined period of time T1, from the start time of the first timer, the controller 62 switches the electromagnetic clutch 24 for the predetermined number of times N, and then the controller 62 terminates the repetition mode, and changes the slide door 11 to the manual opening/closing mode.

According to the third embodiment described above, in addition to the effects of the first embodiment (1) to (3), following effects can be obtained.

(6) In the third embodiment, after the start of performing the repetition mode, the controller 62 terminates the repetition mode when the electromagnetic clutch 24 has repeated the connected state and the disconnected state for a predetermined number of times N. Accordingly, during the repetition mode, the rapid movement of the slide door 11, on the self-weight basis in an inclined direction, can be restricted, while the controller 62 can immediately change the slide door 11 to the manual opening/closing mode after the termination of the repetition mode.

In the meantime, the embodiments described above can be modified as follows.

From the first embodiment to the third embodiment, the control apparatus, for opening/closing a vehicle door, is applied to the opening/closing control of the slide door 11, provided at the side portion of the vehicle. However, the control apparatus for opening/closing a vehicle door can also be applied to other vehicle doors such as a door provided at a rear portion of the vehicle. Further, the control apparatus for opening/closing a vehicle door can be applied, not only to a sliding type vehicle door, but also to a rotational type vehicle door.

From the first embodiment to the third embodiment, the driving mechanism 21 for the slide door is located at the slide door 11. However, the driving mechanism 21 for the slide door can also be located at a step positioned at a lower portion of the slide door 11, and at a pillar positioned at a rear portion of the slide door 11.

From the first embodiment to the third embodiment, the movement of the slide door 11 is detected on the basis of the pulse signals outputted from the sensor 53. However, the movement of the slide door 11 can also be detected directly by means of providing a positional switch at the slide door 11, or the like.

From the first embodiment to the third embodiment, the controller 62 judges that the slide door 11 is moving when a pulse is inputted to the controller 62 from the sensor 53. However, the controller 62 can judge that the slide door 11 is moving when a predetermined number or more pulses are inputted to the controller 62 from the sensor 53.

According to a first aspect of the present invention, a control apparatus for opening/closing a vehicle door includes:

a door opening/closing mechanism for operating the vehicle door to open/close;

a driving source for driving the door opening/closing mechanism;

a connecting/disconnecting means which can be switched between a connected state, in which a driving force is transmitted to the vehicle door from the driving source, and a disconnected state, in which the driving force is not transmitted to the vehicle door from the driving source, the connecting/disconnecting means interposed between the door opening/closing mechanism and the driving source;

a controlling means for controlling the connecting/disconnecting means to the connected state or to the disconnected state;

a door movement-detecting means for detecting a movement of the vehicle door;

the controlling means switching the connecting/disconnecting means from the connected state to the disconnected state when the driving source is stopped during an opening/closing operation of the vehicle door by the driving source; and the controlling means performing a repetition mode, in which the connecting/disconnecting means repeats the connected state and the disconnected state, when the movement of the vehicle door is detected by the door movement-detecting means in the disconnected state of the connecting/disconnecting means.

According to a second aspect of the present invention, in the control apparatus for opening/closing the vehicle door, the controlling means performs the repetition mode when the movement of the vehicle door is detected by the door movement-detecting means within a first predetermined period of time after the connecting/disconnecting means is switched to the disconnected state.

According to a third aspect of the present invention, in the control apparatus for opening/closing the vehicle door, the controlling means terminates the repetition mode when the movement of the vehicle door is not detected by the door movement-detecting means within a second predetermined period of time after the repetition mode is started.

According to a fourth aspect of the present invention, in the control apparatus for opening/closing the vehicle door, the controlling means terminates the repetition mode after a third predetermined period of time has elapsed from the start of the repetition mode.

According to a fifth aspect of the present invention, in the control apparatus for opening/closing the vehicle door, the controlling means terminates the repetition mode when the connecting/disconnecting means has repeated the connected state and the disconnected state for a predetermined number of times after the repetition mode has started.

According to the first aspect of the present invention, the controlling means switches the connecting/disconnecting means to the disconnected state, when the driving source is stopped while the vehicle door is in the partially-opened state during the opening/closing operation, and the controlling means performs the repetition mode, in which the connecting/disconnecting means repeats the connected state and the disconnected state, when the movement of the vehicle door is detected in the disconnected state of the connecting/disconnecting means. Accordingly, when the movement of the vehicle door is not detected in the disconnected state of the connecting/disconnecting means, the controlling means does not perform the repetition mode, therefore unnecessary switching of the connecting/disconnecting means can be inhibited. Accordingly, in comparison with a case where the controlling means necessarily performs the repetition mode in a stopped state of the driving source, the number of operations of the connecting/disconnecting means can be reduced. This enables to expect improvement in durability of the connecting/disconnecting means, reduction of switching work of the connecting/disconnecting means, and restriction of annoying operational noise.

On the other hand, when the movement of the vehicle door is detected in the disconnected state of the connecting/disconnecting means, the controlling means performs the repetition mode. Accordingly, a load (braking force) of the driving source can be intermittently given to the door opening/closing mechanism. Accordingly, the movement of the vehicle door on the basis of the self-weight can be restricted.

According to the second aspect of the present invention, the controlling means performs the repetition mode when the movement of the vehicle door is detected within the first predetermined period of time after the connecting/disconnecting means is switched to the disconnected state. Accordingly, when the movement of the vehicle door is detected within the first predetermined period of time, the movement of the vehicle door, on the self-weight basis, can be restricted. On the other hand, when the movement of the vehicle door is not detected within the first predetermined period of time, the controlling means can immediately change the vehicle door to the manual opening/closing mode in which the vehicle door can be manually operated by an occupant.

According to the third aspect of the present invention, when the movement of the vehicle door is not detected within the second predetermined period of time after the repetition mode is started, the controlling means terminates the repetition mode. Accordingly, when the movement of the vehicle door is restricted by the repetition mode, more than necessary operations of the connecting/disconnecting means can be inhibited. Further, when the movement of the vehicle door is detected while the repetition mode is performed, it can be predicted that the vehicle door will move if the repetition mode is stopped. Accordingly, the repetition mode is continued. Thus, the movement of the vehicle door can be restricted more reliably.

According to the fourth aspect of the present invention, the repetition mode is terminated after the third predetermined time has elapsed from the start of the repetition mode. Accordingly, the movement of the vehicle door, on the self-weight basis, can be restricted for the third predetermined time. On the other hand, after the third predetermined time has elapsed, the controlling means can immediately change the vehicle door to the manual opening/closing mode.

According to the fifth aspect of the present invention, the repetition mode is terminated, when the connecting/disconnecting means has repeated the connected state and the disconnected state for a predetermined number of times, after the start of the repetition mode. Accordingly, the movement of the vehicle door, on the self-weight basis, can be restricted during the repetition mode. On the other hand, the controlling means can immediately change the vehicle door to the manual opening/closing mode after the repetition mode has terminated.

The principles, preferred embodiment and mode of operation of the present invention, have been described in the foregoing specification. However, the invention that is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A control apparatus for opening/closing a vehicle slide door, comprising:

a door opening/closing mechanism for slidably operating the vehicle slide door to laterally move the vehicle slide door between a fully-opened position and a fully-closed position;

a driving source for driving the door opening/closing mechanism;

a clutch operatively disposed between the driving source and the door opening/closing mechanism, the clutch being switchable between a connected state, in which a driving force is transmitted to the vehicle slide door from the driving source, and a disconnected state, in which the driving force is not transmitted to the vehicle slide door from the driving source;

a controlling means for controlling the clutch to be in the connected state or the disconnected state;

a door movement-detecting means for detecting a movement of the vehicle slide door;

the controlling means switching the clutch from the connected state to the disconnected state when the driving source is stopped during an opening/closing operation of the vehicle slide door by the driving source and before the vehicle slide door reaches the fully-opened position and before the vehicle slide door reaches the fully-closed position; and the controlling means performing a repetition mode, in which the controlling means controls the clutch to switch from the disconnected state to the connected state, and then from the connected state to the disconnected state when the movement of the vehicle slide door is detected by the door movement-detecting means in the disconnected state of the clutch.

2. The control apparatus for opening/closing the vehicle slide door according to claim 1, wherein the controlling means performs the repetition mode when the movement of the vehicle door is detected by the door movement-detecting means within a first predetermined period of time after the clutch is switched to the disconnected state.

3. The control apparatus for opening/closing the vehicle slide door according to claim 1, wherein the controlling means terminates the repetition mode when the movement of the vehicle door is not detected by the door movement-detecting means within a second predetermined period of time after the repetition mode is started.

4. The control apparatus for opening/closing the vehicle slide door according to claim 2, wherein the controlling means terminates the repetition mode when the movement of the vehicle door is not detected by the door movement-detecting means within a second predetermined period of time after the repetition mode is started.

5. The control apparatus for opening/closing the vehicle slide door according to claim 1, wherein the controlling means terminates the repetition mode after a third predetermined period of time has elapsed from the start of the repetition mode.

6. The control apparatus for opening/closing the vehicle slide door according to claim 2, wherein the controlling means terminates the repetition mode after a third predetermined period of time has passed from the start of the repetition mode.

7. The control apparatus for opening/closing the vehicle slide door according to claim 1, wherein the controlling means terminates the repetition mode when the clutch has repeated the connected state and the disconnected state for a predetermined number of times after the repetition mode is started.

8. The control apparatus for opening/closing the vehicle slide door according to claim 2, wherein the controlling means terminates the repetition mode when the clutch has repeated the connected state and the disconnected state for a predetermined number of times after the repetition mode is started.

9. The control apparatus for opening/closing the vehicle slide door according to claim 1, wherein the controlling means changes a mode of the vehicle door to a manual opening/closing mode after the controlling means terminates the repetition mode.

10. The control apparatus for opening/closing the vehicle slide door according to claim 2, wherein the controlling means changes a mode of the vehicle door to a manual opening/closing mode after the controlling means terminates the repetition mode.

11. The control apparatus for opening/closing the vehicle slide door according to claim 3, wherein the controlling means changes a mode of the vehicle door to a manual opening/closing mode after the controlling means terminates the repetition mode.

12. The control apparatus for opening/closing the vehicle slide door according to claim 4, wherein the controlling means changes a mode of the vehicle door to a manual opening/closing mode after the controlling means terminates the repetition mode.

13. The control apparatus for opening/closing the vehicle slide door according to claim 5, wherein the controlling means changes a mode of the vehicle door to a manual opening/closing mode after the controlling means terminates the repetition mode.

14. The control apparatus for opening/closing the vehicle slide door according to claim 6, wherein the controlling means changes a mode of the vehicle door to a manual opening/closing mode after the controlling means terminates the repetition mode.

15. The control apparatus for opening/closing the vehicle slide door according to claim 7, wherein the controlling means changes a mode of the vehicle door to a manual opening/closing mode after the controlling means terminates the repetition mode.

16. The control apparatus for opening/closing the vehicle slide door according to claim 8, wherein the controlling means changes a mode of the vehicle door to a manual opening/closing mode after the controlling means terminates the repetition mode.

17. The control apparatus for opening/closing the vehicle slide door according to claim 1, wherein the controlling means switches the clutch from the connected state to the disconnected state when the driving source stops transmitting the driving force during the opening/closing operation of the vehicle door by the driving source.

18. A control apparatus for opening/closing a vehicle slide door, comprising:

a door opening/closing mechanism for slidably moving the vehicle slide door along plural guide rails to laterally move the vehicle slide door between a fully-opened position and a fully-closed position;

a driving source for driving the door opening/closing mechanism;

a clutch operatively disposed between the driving source and the door opening/closing mechanism, the clutch being switchable between a connected state, in which a driving force is transmitted to the vehicle slide door from the driving source, and a disconnected state, in which the driving force is not transmitted to the vehicle slide door from the driving source;

controlling means for controlling the clutch to be in the connected state or the disconnected state;

door movement-detecting means for detecting a movement of the vehicle slide door;

the controlling means switching the clutch from the connected state to the disconnected state when the driving source is stopped during an opening/closing operation of the vehicle slide door by the driving source and before the vehicle slide door reaches the fully-opened position and before the vehicle slide door reaches the fully-closed position; and the controlling means performing a repetition mode in which the controlling means controls the clutch to repeatedly switch the clutch plural times between the disconnected state and the connected state when the movement of the vehicle slide door is detected by the door movement-detecting means in the disconnected state of the clutch.

19. A control apparatus for opening/closing a vehicle slide door, comprising:

a door opening/closing mechanism for slidably operating the vehicle slide door to laterally move the vehicle slide door between a fully-opened position and a fully-closed position;

a driving source for driving the door opening/closing mechanism;

a clutch operatively disposed between the driving source and the door opening/closing mechanism, the clutch being switchable between a connected state, in which a driving force is transmitted to the vehicle slide door from the driving source, and a disconnected state, in which the driving force is not transmitted to the vehicle slide door from the driving source;

controlling means for controlling the clutch to be in the connected state or the disconnected state;

door movement-detecting means for detecting a movement of the vehicle slide door;

the controlling means switching the clutch from the connected state to the disconnected state when the driving source is stopped during sliding movement of the vehicle slide door before the vehicle slide door reaches the fully-opened position and before the vehicle slide door reaches the fully-closed position;

the controlling means performing a repetition mode of the clutch in which the controlling means controls the clutch to repeatedly switch the clutch plural times between the disconnected state and the connected state when the movement of the vehicle slide door is detected by the door movement-detecting means in the disconnected state of the clutch;

a timer which determines an amount of time elapsed from start of the repetition mode during which the clutch is repeatedly switched plural times between the disconnected state and the connected state; and the controlling means terminating the repetition mode and switching the clutch to the disconnected state when it is determined that a predetermined time has elapsed from start of the repetition mode.

* * * * *

UNITED STATES PATENT AND TRADEMARK OFFICE

CERTIFICATE OF CORRECTION

PATENT NO. : 7,607,963 B2
APPLICATION NO. : 11/454796
DATED : October 27, 2009
INVENTOR(S) : Ishihara et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 533 days.

Signed and Sealed this

Twelfth Day of October, 2010

David J. Kappos

David J. Kappos
*Director of the United States Patent and Trademark Office*